US005190219A

United States Patent [19]

Copp, Jr.

[11] Patent Number: 5,190,219

[45] Date of Patent: Mar. 2, 1993

[54] AUTOMATIC SPRAY GUN

[76] Inventor: William H. Copp, Jr., 5 Solomon Pierce Rd., Lexington, Mass. 02173

[21] Appl. No.: 770,251

[22] Filed: Oct. 3, 1991

[51] Int. Cl.[5] ..... B05B 1/26

[52] U.S. Cl. ..... 239/296; 239/300; 239/600; 239/412

[58] Field of Search ..... 239/290, 296, 299, 300, 239/301, 412, 600

[56] References Cited

U.S. PATENT DOCUMENTS 4,934,602 6/1990 Mattson ..... 239/300

5,080,285 1/1992 Toth ..... 239/300

*Primary Examiner*—Andres Kashnikow

*Assistant Examiner*—Lesley D. Morris

*Attorney, Agent, or Firm*—Ernest Kettelson

[57] ABSTRACT

An automatic spray gun for use in an automatic spray system which is a modular unit, wherein each working component is a separate module that can be removed from and re-assembled on the spray gun body itself for cleaning, repair and replacement without disturbing the setting of the gun body in the automatic spray set-up, such as distance from the work pieces to be sprayed, angle and the like. The needle valve which stops and starts the flow of liquid to be atomized and sprayed is operated by an air pressure piston and cylinder component which is a separate module and designed in a way whereby the pressurized air which powers and initiates operation of the piston and cylinder module can also be utilized to start and stop the flow of a separate source of pressurized air to atomize the liquid as it flows from the nozzle orifice and to delay the stop of atomizing air until after flow of pressurized air to hold the needle valve in its open position has been stopped. The atomizing component of the spray gun, the needle valve component, the fluid regulator component, nozzle and nozzle block component are each separate modules which can be removed from and re-assembled on the gun body without disturbing its setting in the automatic spray set-up.

21 Claims, 11 Drawing Sheets

AUTOMATIC SPRAY GUN

BACKGROUND OF THE INVENTION

This invention relates to the field of automatic spray guns for use in an automatic spray gun system, and in particular to a high volume, low pressure (HVLP) spray gun which requires a relatively higher volume of atomizing air at relatively lower pressure.

Prior art spray guns for use in automatic spray systems have been of the assembly-as-a-whole type, wherein the entire spray gun is constructed in such a way that the different working components include integrally formed or connected portions which are in turn part of other working components so that when any one component needs servicing the entire spray gun has to be removed from its setting in the automatic spray system.

The spray gun in accordance with the present invention is particularly unique in that each of the working components of the spray gun has been constructed as a separate module, complete in itself. These modules include first of all the gun body itself having the atomizing air chamber therein and mounting means for mounting in the automatic spray set-up, the needle valve operating piston and cylinder component which is secured to the gun body by two cap screws, the nozzle and nozzle block module to deliver an atomizable liquid through the nozzle orifice which is secured in place within the gun body cavity by a fitting through its cylindrical wall and special construction of the nozzle block housing described in detail later, the atomizing module comprising an air cap, a pattern ring, a detent plate and a compression spring which are secured to the gun body by threading the pattern ring on the front end of the gun body around its open front wall to hold the other parts of this module within the gun body cavity with the compression spring bearing against the nozzle block housing and the detent plate plus air cap sandwiched between the compression spring and air cap, the needle valve module which is not affixed to any other part of the spray gun but has non-fixed operating connections to other parts such as sliding, abutment and the like, wherein it extends through central apertures of the piston and cylinder module, through the gun module and its atomizing air chamber, through the nozzle and nozzle block module with the tapered needle end of the needle valve module extending into the correspondingly tapered nozzle orifice cavity, and the fluid regulating module which is secured to the spray gun by screwing the externally threaded forward end of its cylindrical housing into an internally threaded aperture of the rearwardly facing cover plate of the piston and cylinder module.

Such unique modular construction is of particular commercial importance for spray guns used in robotic or automatic spray set-ups, since the setting of the gun body module itself need never be disturbed in order to service any or all of the other separate, complete in themselves, modules. This not only saves time but even more importantly the distance and angle of the original setting of the gun body can remain exactly the same after servicing of the modules of the modular spray gun in accordance with this invention as before. Thus, the work pieces sprayed after servicing will be exactly the same as those sprayed before, so the finished work products will all have the same uniform appearance.

This is not possible with prior art spray guns which have to be completely removed from their setting within a robotic or automatic spray set up for servicing.

The automatic spray gun in accordance with this invention utilizes a source of pressurized air from a control center, usually operated by a computer, to operate a pneumatic piston and cylinder module for opening the nozzle orifice to start fluid flow by drawing the needle valve module rearwardly when the control source signals such air pressure to flow to the piston and cylinder module and for closing the nozzle orifice to stop fluid flow by signaling such flow of air pressure to stop whereupon a compression spring of the piston and cylinder module biases the piston forwardly and a compression spring of the fluid regulating module biases the needle valve module forwardly to close the nozzle orifice.

By utilizing pressurized air from a control source to both operate and signal operation of the needle valve, the same control source of pressurized air can be utilized to control operation of atomizing air delivered to the spray gun from a different pressurized air source, which can include the feature of continuing flow of atomizing air to the spray gun for a selected time period after the needle valve has been signaled to close so as to make sure that any flow of fluid from the nozzle orifice after the needle valve has been signaled to close, and before it actually does, will be atomized into a spray and will not flow out in an unatomized stream which would ruin the work pieces it falls on. This feature of doubling to also control operation of the atomizing air to the spray gun is the subject of a separate invention, but utilization of a control and operating means for the needle valve of the spray gun which has the capability of being also utilized to control operation of the atomizing air delivered to the spray gun is an important advantage of the spray gun in accordance with this invention over the prior art.

Another improvement over the prior art provided by this invention is the placing of an air pressure gauge at the forward end of the gun body whereby it is possible to simultaneously monitor both the spray on the finished work while it is occurring and the atomizing air pressure within the chamber of the gun body and do so on a continuous basis if desired. It is not necessary to look away from the work in process to see what the air pressure is being delivered to the atomizing air chamber of the spray gun. The ability to place an air pressure gauge at the forward end of the gun body is made possible by the unique construction of the nozzle block housing of the spray gun in accordance with this invention which is described in detail later that permits an air passageway of the atomizing air chamber above the nozzle block housing which must of necessity be located within the forward end portion of the gun body.

Many additional improvements and advantages of the spray gun in accordance with this invention will become apparent from the detail description which follows and from the accompanying drawings.

SUMMARY OF THE INVENTION

It is an object of the invention to provide an automatic spray gun for use in an automatic spray system which is of modular construction wherein each component part of the operating mechanism is complete in itself and can be removed from as well as re-assembled on the gun body without disturbing its existing setting within the automatic spray system.

It is an object of the invention to provide an automatic spray gun for use in an automatic spray system which utilizes a control and operating means for remote control operation of its needle valve component which can also double to control the delivery of atomizing air to its atomizing component.

It is an object of the invention to provide an automatic spray gun for use in an automatic spray system which has a pressure gauge on the forward end of the gun body to enable simultaneous monitoring of both the atomizing air pressure within the air chamber of the spray gun and of the work pieces themselves as they are being sprayed without having to look away from one to see the other.

DESCRIPTION OF PREFERRED EMBODIMENT

Figure 1:
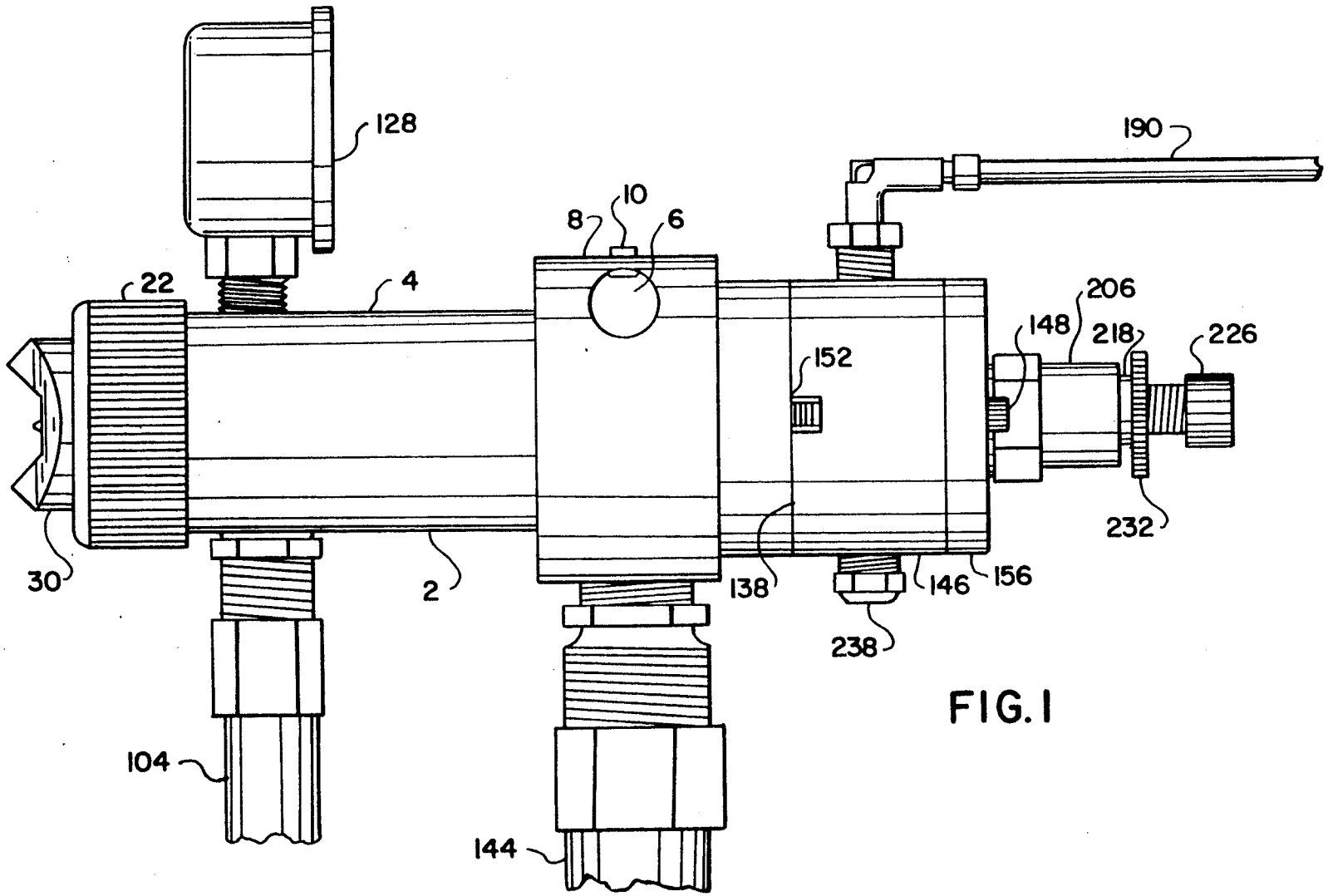
FIG. 1 is an elevation view of a modular high volume, low pressure (HVLP) spray gun in accordance with this invention.
Figure 2:
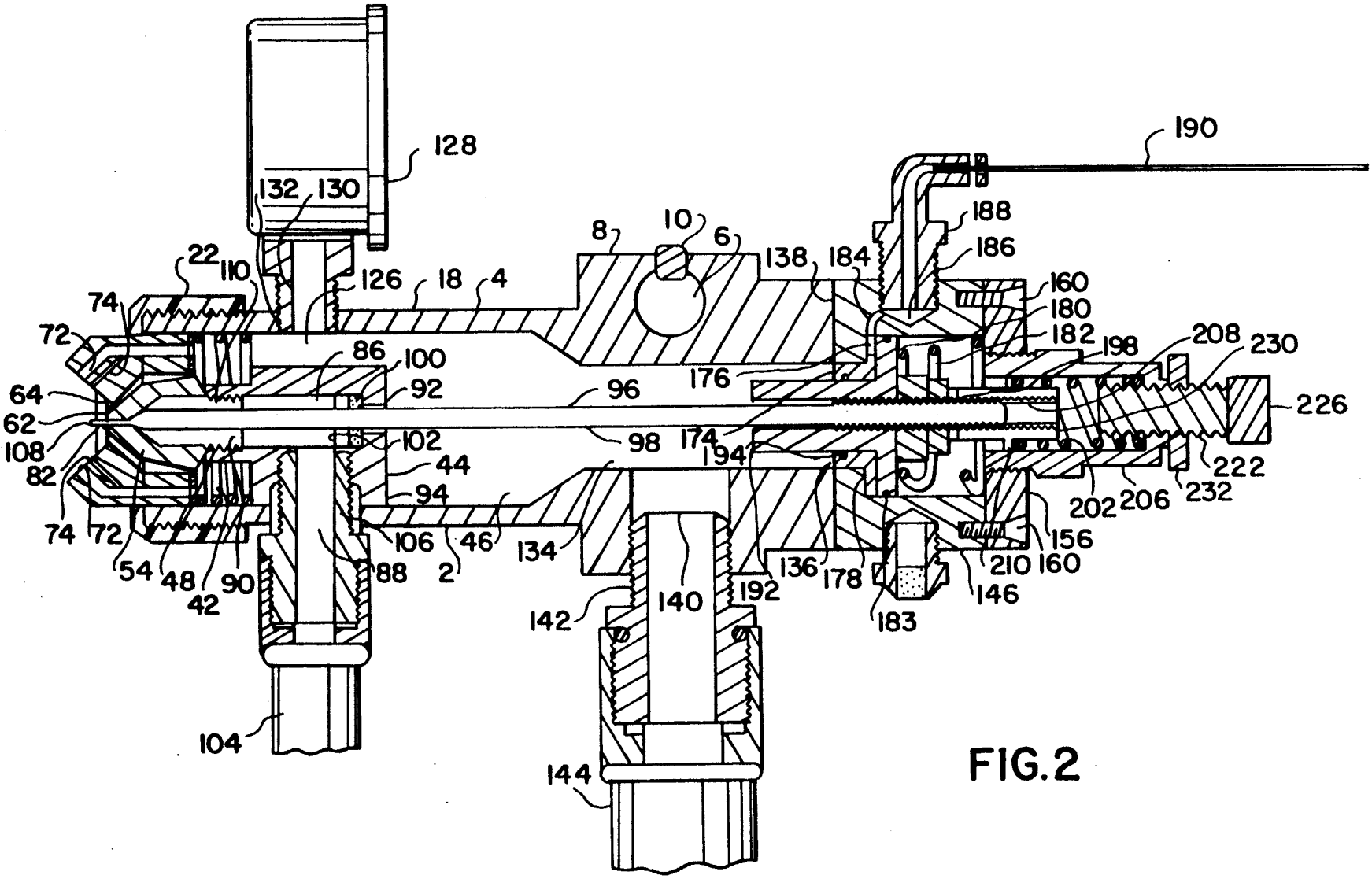
FIG. 2 is a section view of the spray gun shown in FIG. 1.

A modular robotic spray gun in accordance with this invention comprises a generally cylindrical gun body 2 of a high volume low pressure (HVLP) spray gun 4 for use in automated paint spraying operations wherein the modular component parts of the spray gun can be disassembled for servicing or replacement without removing the gun body 2 from its setting at the proper angle and distance in the automated paint spraying set-up in which it has been installed.

The gun body 2 includes an elongated cylindrical mounting aperture 6 extending transversely across an enlarged diameter and thickened wall section 8 of the gun body 2 to receive a mounting bar of an automated paint spraying set-up which will position the spray gun at the proper distance and angle relative to the work pieces to be painted. A set screw 10 is provided to tighten against the mounting bar when the proper positioning has been achieved.

Figure 3:
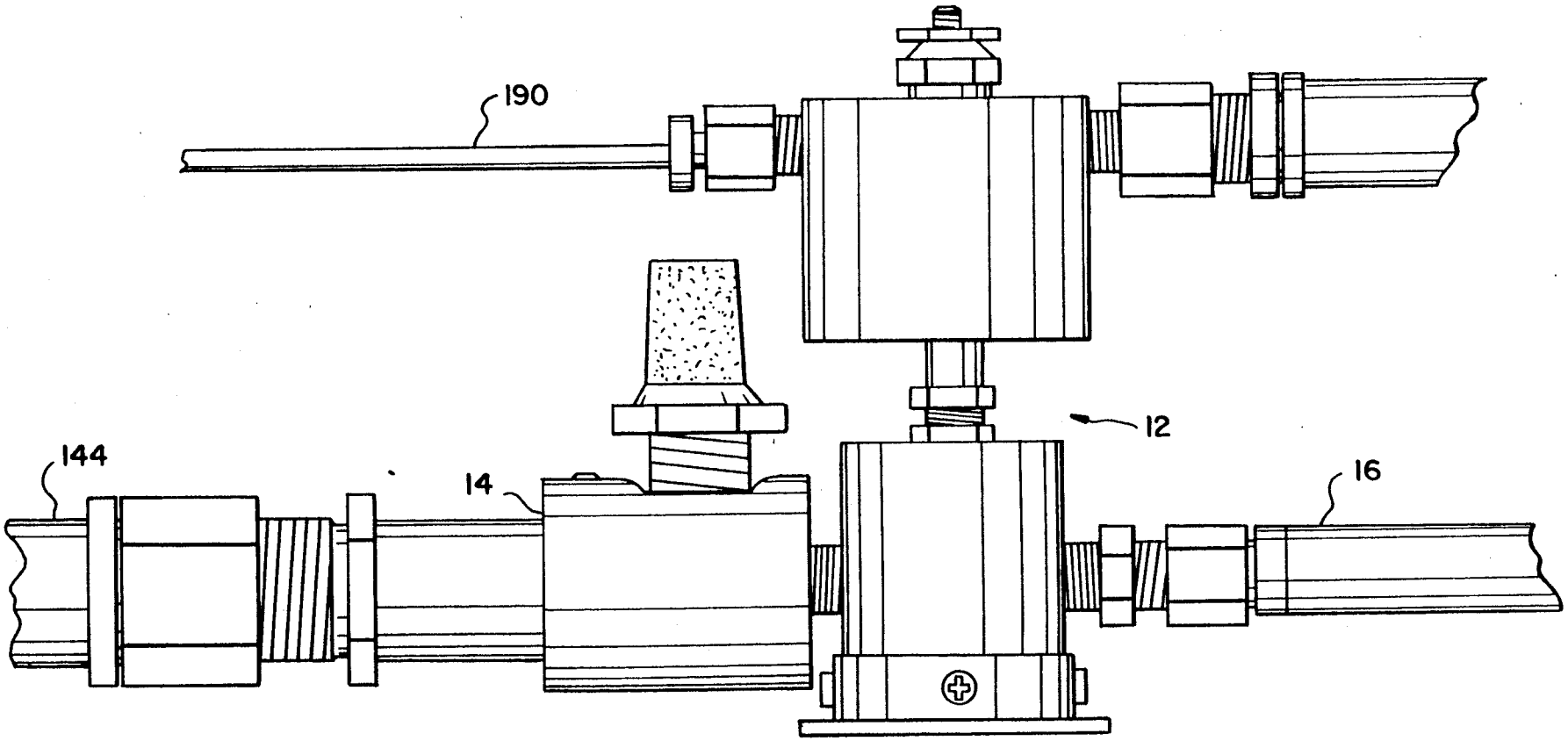
FIG. 3 is an elevation view of a high volume, low pressure (HVLP) air supply and control assembly to illustrate one type of pressurized air supply with which the spray gun in accordance with this invention may be used.
Figure 4:
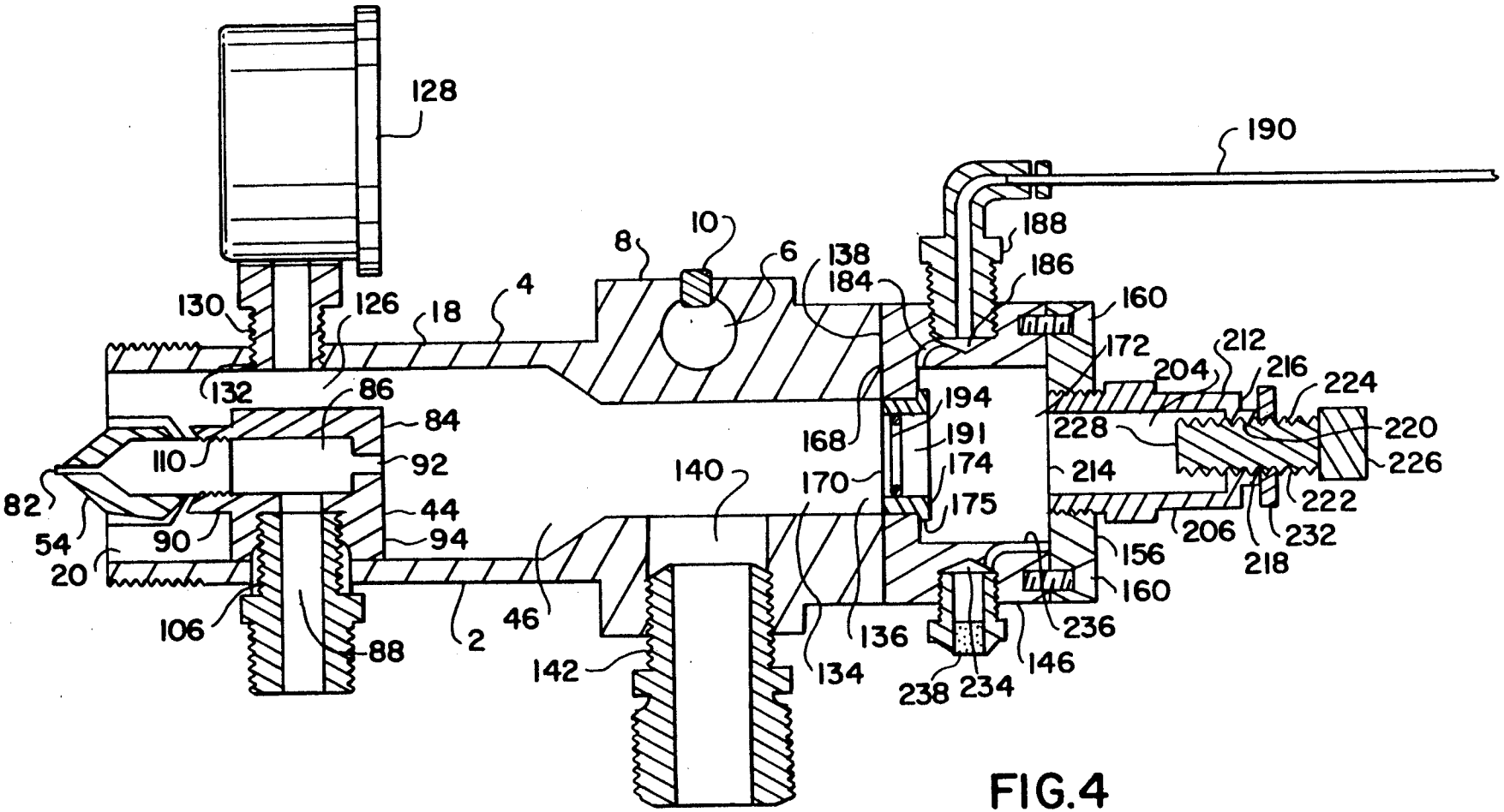
FIG. 4 is a section view of the spray gun shown in FIG. 1 but with the internal operating parts removed to more clearly illustrate the structure of the internal chambers and air passageways therein, as well as those leading to and from the internal chambers.
Figure 5:
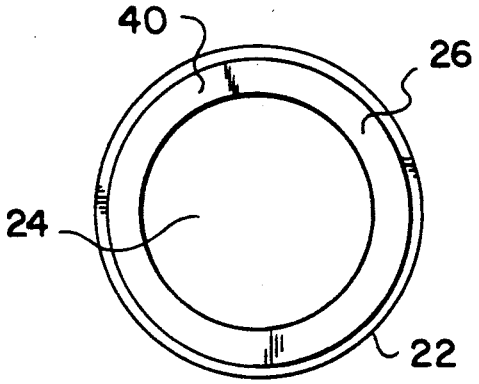
FIG. 5 is an end elevation view of the pattern ring of the spray gun in accordance with this invention taken from the rear.
Figure 6:
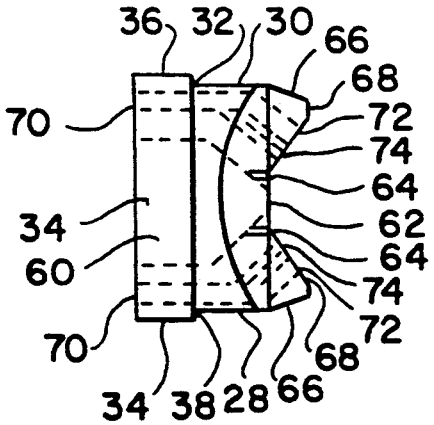
FIG. 6 is a side elevation view of the air cap of the spray gun, with the interior cavity and air channels through the annular wall portion shown in broken lines.
Figure 7:
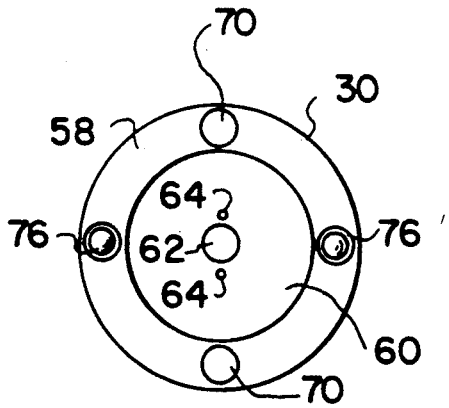
FIG. 7 is an end elevation view of the air cap of the spray gun in accordance with this invention taken from the rear.
Figure 8:
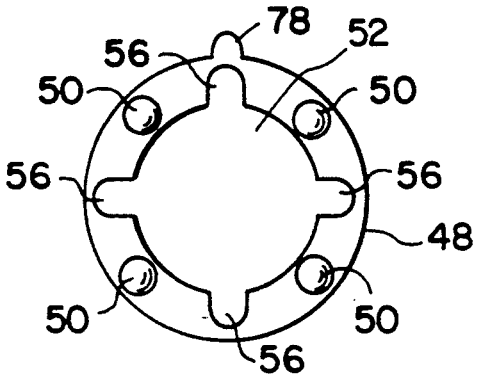
FIG. 8 is an elevation view of the detent plate of the spray gun in accordance with this invention.
Figure 9:
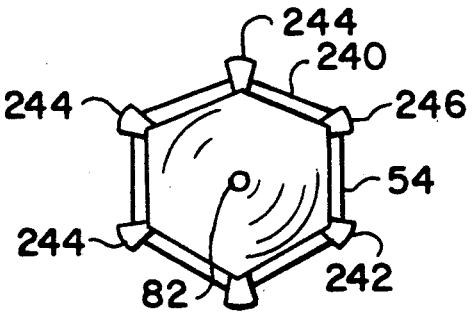
FIG. 9 is an end elevation view of the fluid nozzle of the spray gun in accordance with this invention taken from the front.
Figure 10:
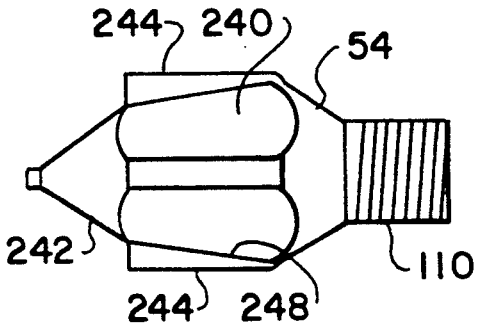
FIG. 10 is a side elevation view of the fluid nozzle shown in FIG. 9.
Figure 11:
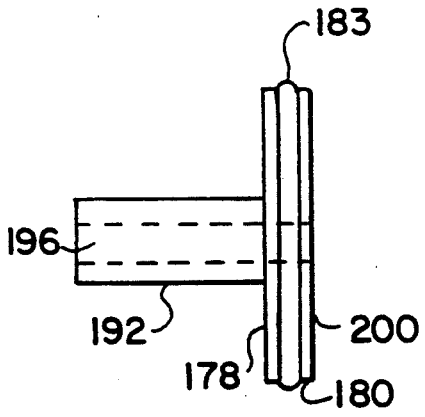
FIG. 11 is a side elevation view of the piston of the spray gun in accordance with this invention.
Figure 12:
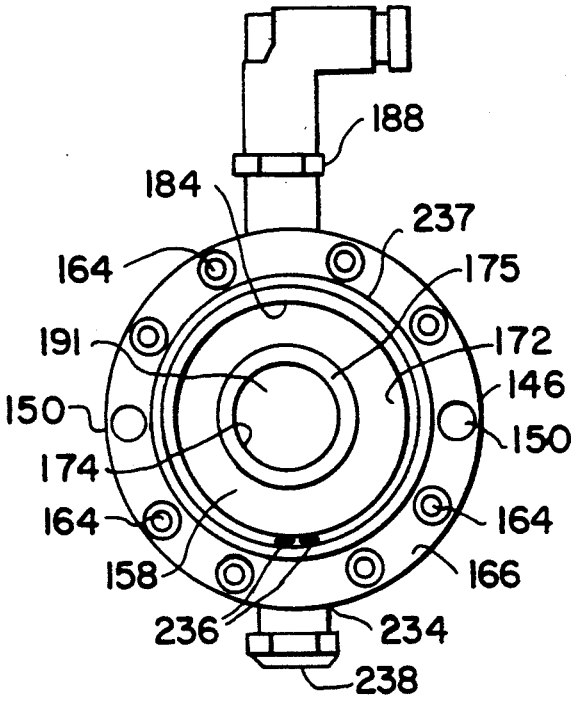
FIG. 12 is an end elevation view of the removable cylinder block of the modular spray gun in accordance with this invention taken from the rear.
Figure 13:
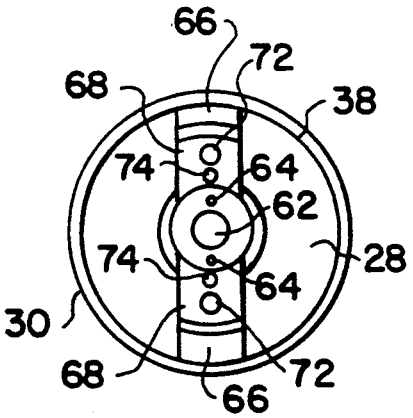
FIG. 13 is an end elevation view of the air cap of the spray gun in accordance with this invention taken from the front.
Figure 15:
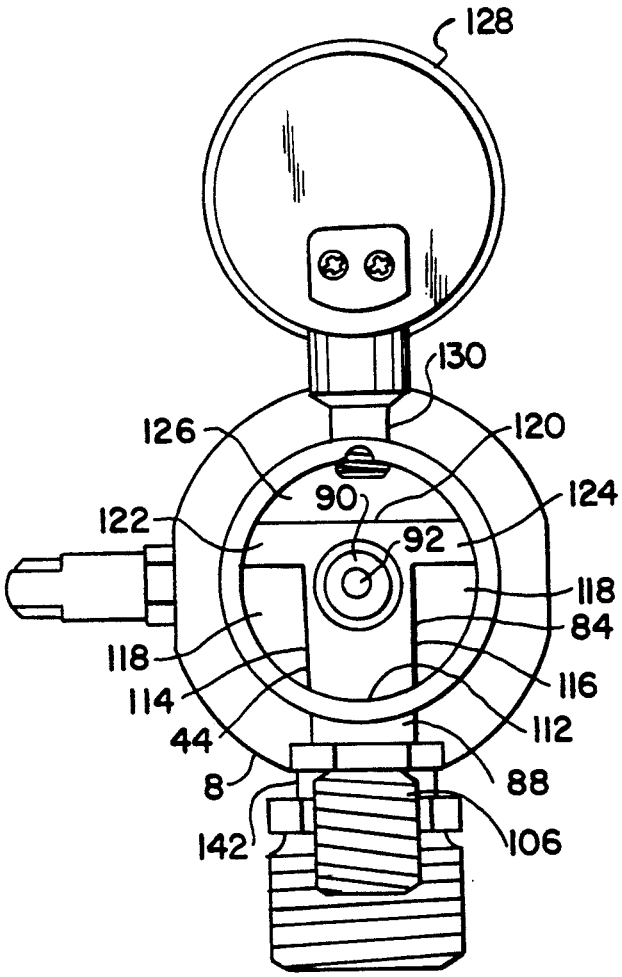
FIG. 15 is an end elevation view of the spray gun in accordance with this invention taken from the front with the air cap, pattern ring, nozzle, detent plate, and spring removed to illustrate the nozzle block as it is seated in the air chamber of the spray gun.
Figure 16:
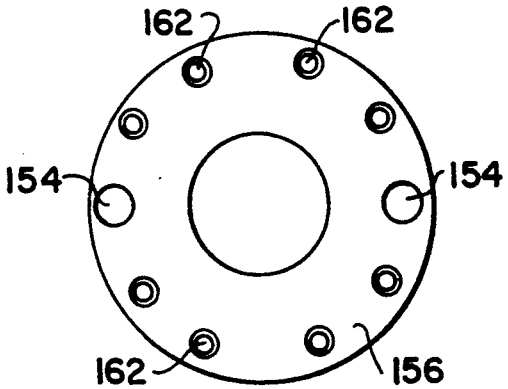
FIG. 16 is an elevation view from the rear of the cover plate which covers the open rear wall of the removable cylinder block of the modular spray gun in accordance with this invention.
Figure 17:
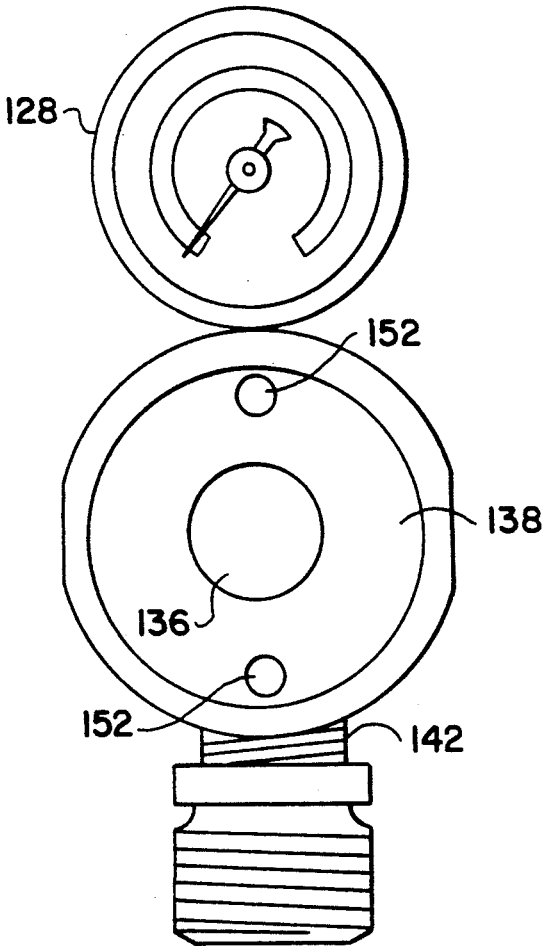
FIG. 17 is an end elevation view from the rear of the gun body of the, modular spray gun in accordance with this invention with the removable cylinder block removed.
Figure 18:
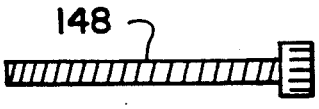
FIG. 18 is an elevation view of one of the cap screws which secure the cover plate and cylinder block to the gun body of the modular spray gun in accordance with this invention.
Figure 19:
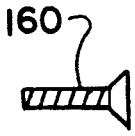
FIG. 19 is an elevation view of one of the tapered head screws which secure the cover plate to the cylinder block.
Figure 14:
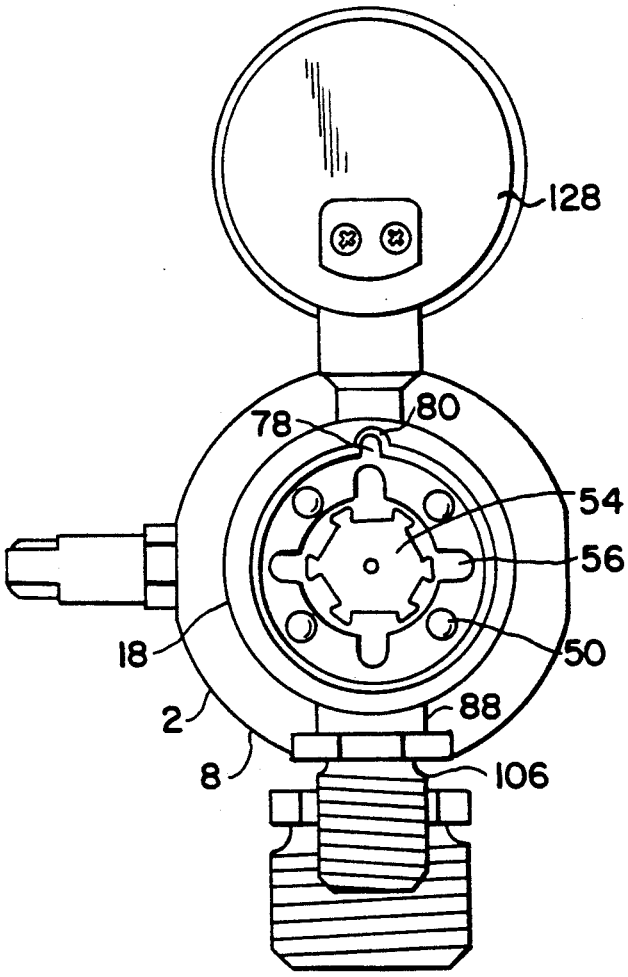
FIG. 14 is an end elevation view of the spray gun in accordance with this invention taken from the front with the air cap and pattern ring removed.

The spray gun 4 in accordance with this invention may be used with any high volume low pressure source of atomizing air such as a turbine pressurized air supply or the high volume low pressure (HVLP) air supply and control assembly 12 as shown in FIG. 3 which includes a venturi member 14 to draw in ambient air at low pressure to combine with pressurized air from an air compressor delivered to the HVLP assembly 12 through supply line 16.

The gun body 2 includes a reduced diameter elongated cylindrical wall 18 extending forwardly or downstream from the enlarged diameter thickened wall section 8 terminating at an open front end wall 20. External threads are formed on the outer surface of the cylindrical wall 18 extending inwardly from front end wall 20 a sufficient distance to receive the internally threaded pattern ring 22. The pattern ring 22 has a large diameter aperture 24 in its forward end wall 26 to receive the cylindrical operating end 28 of the air cap 30 therethrough. The diameter of the cylindrical wall 32 of the forwardly extending operating end 28 corresponds substantially to that of the pattern ring aperture 24 for snug reception therethrough.

The air cap 30 has a rearwardly extending retaining section 34 having a cylindrical wall 36 of slightly enlarged diameter which corresponds substantially in size to the inner diameter of the cylindrical wall 18 of the gun body 2 for snug reception therein through the open front end wall 20 thereof. An annular ledge 38 extends around the air cap 30 between its forward operating end 28 and its slightly larger diameter rearward retaining section 34. The annular ledge 38 faces and engages the inner surface of the annular front wall 40 of the pattern ring 22 when threaded in place on the forward end of the gun body cylindrical wall 18 with the forward operating section 28 of the air cap 30 projecting through the pattern ring aperture 24.

The air cap 30 is biased outwardly from the open front end wall 20 of the gun body 2 by a compression spring 42 which at its rearward end bears against the nozzle block 44 secured within the enlarged diameter cylindrical cavity 46 of the gun body 2 bounded by the forwardly extending cylindrical side wall 18. The forward end of the compression spring 42 bears against a detent plate 48, which is interposed between the air cap 30 and the spring 42. The compression spring biases the air cap 30 forwardly whereupon its annular ledge 38 is in bearing engagement against the inner surface of the annular front wall 40 of pattern ring 22.

When the pattern ring 22 is rotated in one direction of rotation to move inwardly of the gun body 2 it presses the air cap 30 inwardly which when the parts are all assembled results in a wider paint spray pattern. When the pattern ring 22 is rotated in the opposite direction to move outwardly of the gun body 2, the compression spring 42 biases the air cap 30 outwardly which results in a narrower spray pattern.

The detent plate 48 has an outer diameter corresponding to the inner diameter of the cylindrical wall 18 of the gun body 2. It includes four radially and equidistantly spaced apart hemi-spherical sockets 50, a central aperture 52 having a sufficiently large diameter to receive the forward portion of the fluid nozzle 54 therethrough, and four radially and equidistantly spaced apart slots or air passageways 56 opening to the aperture 52 and extending radially outwardly therefrom between respective ones of the hemi-spherical sockets 50.

The air cap 30 has an annular rearwardly facing end wall 58 surrounding the opening to its interior cavity 60. The diameter of the rearward portion of the interior cavity 60 corresponds substantially to the outer diameter of the nozzle 54 for reception of it into the air cap cavity 60. The forward portion of the interior cavity 60 tapers and narrows as it extends to and terminates at the forward central aperture 62 of the air cap 30 which opens to the interior cavity 60. A pair of tiny apertures 64 which also open to the interior cavity 60 are provided on diametrically opposite sides of the central aperture 62 and closely spaced apart therefrom.

The air cap 30 includes a pair of triangularly shaped lugs 66 which project outwardly from the operating end 28, spaced apart radially from the central aperture 62 and on diametrically opposite sides. Each lug includes an angularly extending slightly concave outlet aperture face 68 which extends at an oblique angle to the central axis of the cylindrical cavity 60 and central aperture 62 and which diverge as the outlet aperture faces 68 extend forwardly.

A pair of atomizing air passageways 70 open to the annular rearwardly facing end wall 58 of the air cap 30 at diametrically opposite locations, then extend through the cylindrical wall thereof and angle inwardly at an oblique angle toward the central axis of the cylindrical cavity 60 and central aperture 62 to open at atomizing air outlets 72 in the respective outlet aperture faces 68. A pair of smaller diameter air outlets 74 also open to the respective outlet faces 68 inwardly of the respective air outlets 72 connected by smaller diameter air passageways within the cylindrical wall of the air cap 30 to respective ones of the main atomizing air passageways 70.

The annular rearwardly facing end wall 58 of the air cap 30 also includes a pair of spherical ball detent members 76 mounted therein at diametrically opposite locations, each spaced apart radially and equidistantly from the diametrically opposite positioned atomizing air passageways 70. The outer spherical halves of the detent members 76 releasably seat in the hemi-spherical sockets 50 of the detent plate 48 or in the slots or air passageways 56 when the air cap 30 is rotated to place them in registration. The pattern ring 22 holds the air cap 30 against the detent plate 48, and the compression spring 42 biases the detent plate 48 against the rearwardly facing annular end wall 58 of the air cap 30. The slot-like air passageways 56 have a width and length dimension corresponding to the diameter of the spherical detent members 76 which snugly seat therein when brought into registration therewith.

The structure of the air cap and detent plate as described above will place the atomizing air passageways 70 of the air cap in registration with one pair of the diametrically opposed air passageways 56 of the detent plate when the air cap 30 is rotated to seat its pair of diametrically opposed spherical detent members 76 in the other pair of diametrically opposed air passageways 56 of the detent plate 48. The detent plate 48 has a positioning lug 78 which projects outwardly from the top of its outer edge to seat in a corresponding positioning recess 80 formed in the top of the forward edge of the cylindrical wall 18 of the gun body 2.

When the detent plate 48 is in position with its positioning lug 78 seated in the positioning recess 80, one diametrically opposed pair of the slot-like air passageways 56 is positioned vertically, that is to say one in the twelve o'clock position and the other in the six o'clock position, and the other diametrically opposed pair of such air passageways 56 is positioned horizontally, that is to say one in the three o'clock position and the other in the nine o'clock position.

One diametrically opposed pair of the hemi-spherical sockets 50 is at such time positioned at a first diagonal wherein one of them is mid-way between the twelve o'clock position and three o'clock position and the other mid-way between the six o'clock and nine o'clock position. The other pair of sockets 50 is at such time positioned at a second diagonal which extends normal to and intersects the first diagonal, wherein one of the sockets 50 is midway between the three o'clock and six o'clock position and the other mid-way between the nine o'clock and twelve o'clock position.

The projecting triangular lugs 66 of the air cap 30 enable the user to rotate the air cap to a first operating position wherein the diametrically opposed lugs 66 are in the vertical position, to a second operating position wherein such lugs are in the horizontal position, and to a third operating position wherein such lugs are in either one of a first or second diagonal position.

When the lugs 66 are in the vertical position, the spherical detent members 76 of the air cap 30 are seated in the horizontally positioned slot-like air passageways 56 of the detent plate 48. At such time, the diametrically opposed air passageways 70 through the air cap 30 are in registration with the detent plate air passageways 56 which are in the vertical position. The pair of small diameter apertures 64 closely spaced apart from the central aperture 62 of the air cap are at such time in the vertical position above and below the central aperture 62, as are the atomizing air outlets 72 and 74 in the aperture outlet faces 68 of the vertically positioned air cap lugs 66. In such position of the air cap 30, paint from the nozzle orifice 82 will be formed in a jet having a horizontally extending elongated oval cross-sectional configuration.

When the lugs 66 are in the horizontal position, the spherical detent members 76 of the air cap 30 are seated in the vertically positioned pair of slot-like air passageways 56 of the detent plate 48. At such time, the diametrically opposed air passageways 70 through the air cap 30 are in registration with the detent plate air passageways 56 which are in the horizontal position. The pair of small diameter apertures 64 closely spaced apart from the central aperture 62 of the air cap are at such time in the horizontal position, one on each opposite side of the central aperture 62, as are the atomizing air outlets 72 and 74 in the aperture outlet faces 68 of the horizontally positioned air cap lugs 66. In such position of the air cap 30, paint from the nozzle orifice 82 will be formed in a jet having a vertically extending elongated oval cross-sectional configuration.

When the lugs 66 are rotated to either the first or second diagonal position, the detent members 76 of the air cap 30 are seated in one of the pairs of diametrically opposed sockets 50 of the detent plate 48 extending in one of the diagonal positions, and the diametrically opposed air passageways 70 through the air cap 30 are at such time in registration with the other of the pairs of diametrically opposed sockets 50 of the detent plate 48 which extend in the other of the two diagonal positions. At such time, the pair of small diameter apertures 64 closely spaced apart from the central aperture 62 of the air cap on opposite sides thereof are in one or the other of the said two diagonal positions. At this time, the atomizing air outlets 72 and 74 in the aperture outlet faces 68 of the diagonally positioned air cap lugs are also in the diagonal position. However, even though in this position the air passageways 70 of the air cap are facing respective ones of the sockets 50 of the detent plate 48 rather than its air passageways 56 so as to block direct passage of air from the gun's air chamber 46 into the air passageways 70, atomizing air from the atomizing air chamber 46 can still reach the air passageways 70 of the air cap indirectly to provide atomizing air through the atomizing air outlets 72 and 74 of the aperture outlet faces 68 of the diagonally positioned air cap lugs 66, as well as through the small diameter apertures 64. A relatively greater amount of air from the gun's air chamber 46 will flow through the air cap's central aperture 62 than when its air passageways 70 are in registration with detent plate apertures 56 for direct flow of pressurized air through passageway 70 from the air chamber 46. In this position of the air cap 30, paint from the nozzle orifice 82 will flow in a jet having a circular cross-sectional configuration.

The nozzle block 44 comprises a housing 84 of substantially rectangular cross-section having a cylindrical nozzle block chamber 86, an internally threaded paint inlet port 88 opening thereto, an internally threaded paint outlet port 90 leading from the chamber 86, and a bore 92 through the rear end wall 94 of the nozzle block housing 84 to receive the shank 96 of the elongated needle valve member 98. A packing member 100 is pressed against the inner surface of the rear end wall 94 of the chamber 86 adjacent the bore 92, held in place by packing screw 102, to seal the needle receiving bore 92 against leakage of paint therethrough.

A paint supply conduit 104 is connected at one end to the externally threaded fitting 106 threadedly received in the paint inlet port 88, and at its opposite end to a supply of paint under pressure for feeding into the nozzle block chamber 86 and out through the nozzle orifice 82 when the needle valve member 98 is retracted to withdraw its needle end 108 from the orifice 82.

The nozzle 54 has an externally threaded inlet port 110 extending rearwardly which is threadedly received in the internally threaded paint outlet port 90 of the nozzle block housing 84 to connect the nozzle to the nozzle block.

The nozzle block housing 84 has a bottom wall 112 of arcuately shaped cross-section to rest on the bottom of the inner surface of cylindrical wall 18 surrounding the atomizing air chamber 46 of the gun body 2. The paint inlet port 88 extends through the arcuate bottom wall 112. The nozzle block housing 84 has a pair of vertically extending side walls 114 and 116 spaced apart a distance less than the cross-sectional dimension of the cylindrical atomizing air chamber 46, thus providing a pair of atomizing air channels 118 on each side of the nozzle block housing 84 for atomizing air to reach the air cap 30 and its atomizing apertures.

The nozzle block housing 84 extends upwardly from the bottom wall 112 and terminates at a top wall 120 at a point which is short of the top portion of cylindrical wall 18 surrounding the atomizing air chamber 46. A pair of integrally formed laterally extending arms 122 and 124 extend outwardly from opposite sides of the nozzle block housing 84 at the level of the top wall 120 to reach and bear against opposite portions of the inner surface of the cylindrical atomizing air chamber 46. The outer surfaces of the laterally extending arms 122 and 124 are arcuate to correspond to the curvature of the inner surface of cylindrical wall 18. The top wall 120 and laterally extending arms 122 and 124 extend laterally across the cylindrical atomizing air chamber 46 at a location above the central axis thereof. Thus the laterally extending arms 122 and 124 bearing against portions of the upper half of the cylindrical wall 18 and the bottom wall 112 bearing against a portion of the lower half of the cylindrical wall 18 holds the nozzle block housing 84 in place within the cylindrical atomizing air chamber 46 and against any lateral movement relative thereto. By constructing the housing 84 to terminate at a top wall 120 short of the upper surface of the cylindrical chamber 46, a third atomizing air channel 126 is provided above the nozzle block housing 84 for atomizing air to reach the air cap 30 and its atomizing apertures.

The atomizing air channel 126 which this structure makes possible above the nozzle block housing 84 also makes it possible to mount an air pressure gauge 128 at this forward location of the gun body where the workman can conveniently read the air pressure within the atomizing air chamber 46 at the same time as he is looking at the atomized paint being sprayed from the outlet end of the gun. The pressure gauge 128 is mounted at this forward end of the spray gun by an externally threaded inlet port fitting 130 threadedly received in an internally threaded gauge receiving aperture 132 through the cylindrical wall 18 at a location above the nozzle block housing 84, immediately rearward of the externally threaded section extending rearwardly from the open front end wall 20 of the gun body 2, and opening to the atomizing air channel 126 above the top wall 120 of the nozzle block housing 84.

The atomizing air chamber 46 extends rearwardly from the open front wall 20, and tapers inwardly at the thickened wall section 8 of the gun body 2, to continue rearwardly in a smaller diameter chamber 134 which terminates at piston receiving aperture 136 opening to the end wall 138 of the gun body 2.

Atomizing air inlet port 140 opens to the smaller diameter chamber 134 and is internally threaded to receive the externally threaded fitting 142 connected to atomizing air supply line 144 which in turn is connected to a source of pressurized atomizing air, such as the high volume, low pressure (HVLP) air supply and control assembly 12 shown in FIG. 3.

The modular spray gun 4 includes a separable modular cylinder body 146 which can be connected to and removed from the gun body 2 by a pair of elongated cap screws 148 which extend through apertures 150 on diametrically opposite sides of the cylinder body 146 to be received in internally threaded apertures 152 opening at diametrically opposite sides of the gun body rearwardly facing end wall 138. The cap screws 148 also extend through diametrically opposite apertures 154 through the cover plate 156 which in turn is secured to cover the open rear wall 158 of the cylinder body 146 by a plurality of tapered head screws 160 through countersunk apertures 162 around the perimeter of the cover plate to be received in the corresponding internally threaded apertures 164 spaced apart around and opening to the annular rearwardly facing end wall 166 of the cylinder body 146.

The front wall 168 of the cylinder body has a central aperture 170 opening to the cylinder cavity 172. A cylindrical bearing 174 is secured within the central aperture 170, having an outer diameter corresponding to the inner diameter of the central aperture 170 for a press fit therein. The bearing 174 includes an annular flange 175 at its rearward end bearing against the inner surface of the front wall 168 of the cylinder body. The bearing 174 is also secured within the central aperture 170 by an epoxy material. The forwardly facing end wall of the bearing 174 is substantially flush with the front wall 168 of the cylinder body. The rearwardly facing flange 175 of the bearing 174 extends rearwardly beyond the inner surface of the cylinder body front wall 168 about one-sixteenth of an inch to provide a small annular space 176 of about one-sixteenth inch depth between the inner surface of the cylinder body front wall and the forwardly facing surface 178 of the piston flange 180 when the piston is biased by compression spring 182 to its forward most position within the cylinder cavity 172 at which time forwardly facing piston flange surface 178 is in abutting engagement against the rearwardly facing end wall of the bearing flange 175. The piston flange 180 has an outer diameter which corresponds in dimension to the inner diameter of the cylinder cavity 172 for a snug slidable fit of the piston flange 180 therein. The peripheral outer wall of the piston flange 180 includes an annular groove to receive and hold an O-Ring 183 therein to provide an air tight seal between the inner surface of the cylinder cavity wall and the corresponding annular wall of the piston flange 180.

A connecting port 184 opens at one end to the small annular space 176 and at its opposite end to the inlet port 186, connected by threaded fitting 188 to supply line 190 which in turn is connected to a source of pressurized air which controls opening of the needle valve assembly to start the flow of paint through nozzle orifice 82.

The inner diameter of the bore 191 of the cylindrical bearing 174 corresponds in dimension to substantially that of the outer diameter of the tubular piston extension 192 for a snug slidable fit of the tubular piston extension 192 within the bore of the cylindrical bearing 174. A small O-Ring 194 is seated in an internal annular groove around the inner surface of the bore of the cylindrical bearing 174 to provide an air tight seal between the inner surface of the bore and the corresponding outer surface of the tubular piston extension.

A cylindrical central bore 196 extends through the tubular piston extension 192 and the piston flange 180 to receive the shank 96 of the needle valve member 98 therethrough. The diameter of the shank 96 is slightly smaller than the bore 196 through the tubular extension 192 and the flange 180 of the piston whereby the needle valve member 98 is free to slide within the bore 196 and move reciprocally relative to the piston.

The piston's tubular extension 192 extends forwardly of the piston flange 180 a distance greater than or at least as great as the distance the piston flange 180 travels forwardly and rearwardly in the cylinder cavity 172 between its fully forward position and its fully rearward position, whereby the piston's tubular extension 192 is slidingly retained within the bore 191 of the bearing 174 throughout the entire forward and rearward movement of the piston to hold it in continuous axial alignment throughout its travel with the central axis of the cylinder body 146 and the cylindrical gun body 2 with which the cylinder body 146 is axially aligned.

The needle valve member 98 comprises an elongated shank 96 which terminates at its forward end in the narrowed diameter needle end 108 which tapers to a pointed end to seat within and close the nozzle orifice 82 when in its fully forward position. The elongated shank 96 terminates at its opposite end in an externally threaded section on which an internally threaded stop member 198 is positioned to define the rear abutment surface of the needle valve member 98 which abuts against the rearwardly facing surface 200 of the piston flange 180 under the forward bias of the needle spring 202 seated in the cylindrical cavity 204 of the fluid regulating member 206. An internally threaded driving ring member 208 is also threadedly received on the externally threaded section of the needle valve member 98, rearwardly of the stop member 198. The driving ring member 208 includes an annular abutment flange 210 extending radially outwardly from the cylindrical wall of the driving ring member 208 for abutment thereagainst by the needle spring 202.

The fluid regulating member 206 comprises a cylindrical body having a cylindrical wall 212 surrounding the cavity 204, an open front wall 214, a solid rear wall 216 including a reduced diameter spacer portion 218 extending rearwardly therefrom, and an internally threaded central aperture 220 through the solid rear wall 216 and spacer portion 218 to receive the externally threaded fluid regulating screw component 222. The fluid regulating screw component 222 includes an elongated threaded shank 224 having a knob 226 at its rearward end and an abutment surface at its forward end 228 for bearing engagement against the rear wall 230 of the driving ring member 208 when the needle valve member 98 is moved rearwardly to its valve open position. The fluid regulating screw component 222 limits the rearward travel of the needle valve member 98 and regulates the amount the needle 108 opens the nozzle orifice 82.

The coiled needle spring 202 bears at one end against the inner surface of the solid rear wall 216 of the fluid regulating member cavity 204 and at its opposite end against the annular abutment flange 210 of the driving ring member 208. The knob 226 of the fluid regulating screw component 222 extends outwardly and rearwardly from the solid rear wall 216 and spacer portion 218, its threaded shank 224 extending forwardly through the internally threaded aperture 220 into the cavity 204 of the fluid regulating member 206 where it extends through the center of the coiled needle spring 202 for bearing engagement of its forward end 228 against the rear wall 230 of the driving ring member 208 when the needle valve member 98 has been moved rearwardly the preselected distance to open the nozzle orifice 82 the preselected amount. The fluid regulating screw component prevents opening of the nozzle orifice 82 beyond whatever preselected amount has been chosen to thereby limit and regulate the amount of paint which can flow therethrough.

The distance the forward end 228 of the fluid regulator shank 224 is spaced apart from the rear wall 230 of the driving ring member 208 when the needle valve member 98 is biased to its fully forward and valve closed position may be adjusted by rotation of the fluid regulator knob 226. If a greater flow of paint is desired, its spaced apart distance is made greater to enable the needle valve member 98 to withdraw its needle 108 farther from the nozzle orifice 82. If a lesser flow of paint is desired, its spaced apart distance is made less to limit the distance the needle 108 can be withdrawn from the orifice 82 thereby limiting the size of its opening. When the desired setting of the fluid regulating screw component 222 has been selected, an enlarged diameter lock nut 232 threadedly received on the regulator operator's shank 224 may be tightened by hand against the rearwardly facing surface of the spacer portion 218 of the fluid regulating member's rear wall 216, to thereby lock and hold the fluid regulating screw component 222 at that setting.

The cylinder body 146 includes an internally threaded pressure release outlet 234 to reduce back pressure on the piston flange 180 within the cylinder cavity 172 when pressurized air from the needle control supply line 190 is flowed into the cylinder cavity 172 and the small annular air space 176 in front of the piston flange 180 to move it and the needle valve rearwardly to open the nozzle orifice 82. The pressure release outlet 234 extends inwardly of the cylindrical wall of the cylinder body 146 a short distance and terminates at a solid end wall, to which a pair of small diameter parallel connecting ports 236 open and which extend to the annular rearwardly facing end wall 166 of the cylinder body 146 where they open adjacent the rear wall opening to the cylinder cavity 172, at a location radially inwardly from the annular O-Ring 237 seated in an annular groove around the annular end wall 166 of the cylinder body 146. The O-Ring 237 provides an air tight seal between the cover plate 156 and the cylinder body 146. By locating the openings to the pressure release connecting ports 236 radially inwardly of the air sealing O-Ring 237, back pressure air is able to reach those openings and flow to the pressure release outlet 234. An externally threaded air filter fitting 238 is threadedly received in the internally threaded pressure release outlet 234 to permit back pressure air to escape and to prevent intake of contaminants.

The nozzle 54 has an externally threaded inlet port 110 received in the internally threaded outlet port of the nozzle block housing 84. The nozzle 54 comprises a slightly tapering six-sided outer wall portion 240 which tapers and converges inwardly to a slight extent as it extends forwardly, and a relatively short conical portion 242 at the forward end tapering inwardly and forwardly to terminate at the small diameter nozzle orifice 82. Six outwardly projecting vanes 244 are spaced apart radially around the outer wall portion 240 along the respective edges of each of the six sides. The vanes 244 have a V-shaped cross-section with somewhat arcuate outer edges 246 which extend longitudinally parallel to the central longitudinal axis of the nozzle 54. The inner edges 248 of the vanes 244 at their junction with the outer wall 240 with which they are integrally formed extend at a diagonal, sloping inwardly as they extend forwardly.

The somewhat arcuate outer edges 246 of the vanes 244 bear against the inner surface of the cylindrical rearward portion of the interior cavity 60 of the air cap 30 when the nozzle is received therein. The six sided outer wall portion 240 is thereby spaced apart a short distance from the inner surface of the air cap cavity 60, whereby atomizing air from the atomizing chamber 46 of the gun body can flow into the air cap cavity 60 over the outer surface of the nozzle 54 for discharge through the central aperture 62 of the air cap and through the pair of small diameter apertures 64 on opposite sides of the air cap's central aperture 62.

In operation, paint from a pressurized supply source is available in the chamber 86 of the nozzle block housing 84 to flow out through the nozzle orifice 82 when the needle valve member 98 is moved rearwardly to withdraw its needle end 108 from its valve closed position to open the nozzle orifice 82. When a painting operation is to begin, pressurized air from a computer control or other control source is flowed through supply line 190 to provide sufficient air pressure to the forwardly facing surface of the piston flange 180 to move it rearwardly against the bias of the compression spring 182. The rearwardly facing surface of the piston flange 180 is in bearing engagement against the forwardly facing abutment surface of the internally threaded stop member 198 threadedly received on the externally threaded end of the shank of the needle valve member 98. When the piston flange 180 is moved rearwardly, the needle valve member 98 is also moved rearwardly to withdraw the forward needle end 108 from the nozzle orifice 82 so paint under pressure can begin to flow therethrough from the nozzle block chamber 86 from the pressurized paint supply source.

At the same time, pressurized air from an atomizing air source is flowed through supply line 144 to fill the gun's atomizing air chamber 46 with pressurized air which then flows through the atomizing apertures 70 and atomizing outlets 62, 64, 72 and 74 of the air cap 30 to atomize and spray the paint coming through the nozzle orifice 82.

The pattern ring is rotated to move inwardly drawing the air cap 30 inwardly to provide a wide spray pattern and the opposite to provide a more narrow spray pattern. As the pattern ring is rotated to move outwardly of the gun body 2, the compression spring 42 bearing against the detent plate 48 biases the air cap 30 outwardly. Thus, a wider or narrower spray pattern can be achieved by rotating the pattern ring to move inwardly or outwardly.

To achieve a paint jet from the orifice 82 having an elongated oval horizontal cross-section, the spray cap lugs 66 are rotated to their first operating position wherein they are in their vertical position. To achieve a paint jet from the orifice 82 having an elongated oval vertical cross-section, the spray cap lugs 66 are rotated to their second operating position wherein they are in their horizontal position. To achieve a paint jet from the orifice 82 having a circular cross-section, the spray cap lugs are rotated to their third operating position wherein they are in either one or the other of the aforesaid first or second diagonal positions.

When the painting operation is to be discontinued, pressurized air from the computer control or other control source is shut off. The compression spring 82 in the cylinder cavity 172 then biases the piston flange 180 forwardly to bear against the flange 175 of the piston bearing 174 through the front wall of the cylinder body 146. The needle spring 202 seated in the cylindrical chamber of the fluid regulating member 206 bears against the annular flange 210 of the driving ring member 208 threaded on the rearward end of the needle valve member 98 to bias it forwardly and thereby seat its needle end 108 in the nozzle orifice 82 to close it and discontinue flow of paint therethrough.

The flow of atomizing air is also discontinued through supply line 144 when the painting operation is to be discontinued. This flow of atomizing air should not be discontinued until the needle end 108 of the needle valve member 98 has fully seated in the nozzle orifice 82 to completely shut off the flow of paint therethrough. Otherwise, a stream of unatomized paint will continue to flow through the orifice on to the item being painted resulting in a defective paint job. The high volume, low pressure (HVLP) air supply and control assembly 12 shown in FIG. 3, includes an inventive feature whose details are disclosed and claimed in a separate patent application which provides a sufficient time delay for shut down of the atomizing air until the needle valve is fully seated and the nozzle orifice fully closed to thereby prevent any after-flow of unatomized paint from the nozzle orifice.

The modular construction of the spray gun 4 in accordance with this invention makes it possible to remove the cylinder body 146 from the gun body 2 and re-connect it thereto without in any way disturbing the setting of the spray gun 4 in the set-up in which it is being used. The other component parts may also be removed from and re-assembled in the gun body 2 while it remains undisturbed in its original setting.

During operation of the spray gun, the air pressure gauge 128 mounted at the forward end of the gun body 2 in communication with the air channel 126 which this invention provides directly above the nozzle block housing 84 makes it possible to readily monitor the air pressure at the outlet on a continuous basis while at the same time monitoring the spray of paint on the work pieces.

The fluid regulating member 206 controls the amount of paint that can flow through the nozzle orifice 82 by limiting the distance the needle 108 can be withdrawn from its fully closed position. The farther the needle 108 is withdrawn from the orifice, the less it obstructs the orifice because of the tapering towards an outer end point construction of the needle and the orifice cavity, thereby allowing more paint to flow through the nozzle orifice 82. To allow more paint to flow, the adjusting screw 222 of the fluid regulating member 206 is rotated to move rearwardly or outwardly allowing the needle 108 to be withdrawn further from the orifice 82 before the end wall 230 of the ring member 208 on the opposite end of the needle valve member 98 comes into abutting contact with the forward end 228 of the adjusting screw component 222. To allow less paint to flow, the adjusting screw component is rotated to move forwardly or inwardly.

Figure 20:
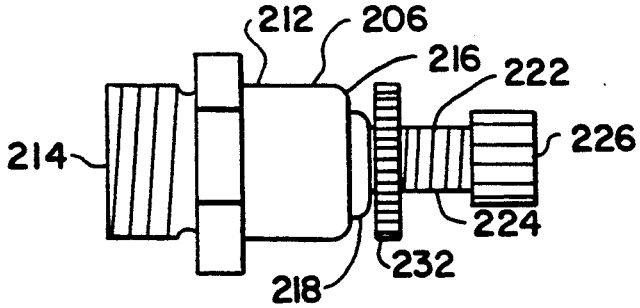
FIG. 20 is a side elevation view of the fluid regulator component of the spray gun in accordance with this invention.

When the desired setting of the screw component 222 of the fluid regulator has been achieved, the lock nut 232 can be tightened against the rear wall 216 of the fluid regulator member 206. A reduced diameter spacer portion 218 of the rear wall 216 is provided to facilitate manual operation of the lock nut 232 by use of one's thumb and fore finger, and to enable use of a lock nut whose outer diameter is no greater than the outer diameter of the cylindrical wall 212 of the fluid regulator member 206 as illustrated in FIG. 20. The reduced diameter of the spacer portion 218 provides a reduced friction surface for the lock nut 232, which provides enough friction to hold the lock nut against rotation when tightened thereagainst but not so much frictional force that it is difficult to loosen the lock nut manually when a new setting of the screw component 222 is desired.

I claim:

1. A spray gun for use in an automatic spray gun system, comprising a plurality of individual modular components and connecting means to assemble into an operational spray gun and to disassemble for cleaning, repair and replacement, including a pressurized air chamber module to receive pressurized air for atomization of liquid to be sprayed from said spray gun, a pressurized liquid housing module for connection to said pressurized air chamber module to receive pressurized liquid to be atomized and sprayed from said spray gun, first connecting means to connect said pressurized liquid housing module to said pressurized air chamber module, a nozzle module having a nozzle orifice for connection to said pressurized liquid housing module to receive pressurized liquid therefrom and flow through said nozzle orifice, second connecting means to connect said nozzle module to said pressurized liquid housing module, an elongated needle valve member module having a forwardly extending needle end tapering to a point for seating in said nozzle orifice for closure thereof when fully seated, an operating means module for connection to said pressurized air chamber module and to said needle valve member module to move said needle valve member module into and out of fully seated engagement with said nozzle orifice of said nozzle module, third connecting means to connect said operating means module to said pressurized air chamber module, fourth connecting means to connect said operating means module to said needle valve member module for movement thereof into and out of said fully seated engagement with said nozzle orifice, an atomization means module for connection to said pressurized air chamber module to receive pressurized air therefrom and direct it on said pressurized liquid as it flows through said nozzle orifice, and fifth connecting means to connect said atomization means module to said pressurized air chamber module.

2. A spray gun for use in an automatic spray gun system as set forth in claim 1, wherein said operating means module includes a first operating means module for connection to said needle valve member module to move it out of said fully seated engagement with said nozzle orifice for opening thereof, and a second operating means module for connection to said needle valve member module to move it into said fully seated engagement with said nozzle orifice for closure thereof.

3. A spray gun for use in an automatic spray gun system, comprising a plurality of individual module components and connecting means to assemble into an operational spray gun and to disassemble for cleaning, repair and replacement, including a pressurized air chamber module to receive pressurized air for atomization of liquid to be sprayed from said spray gun, a pressurized liquid housing module for connection to said pressurized air chamber module to receive pressurized liquid to be atomized and sprayed from said spray gun, first connecting means to connect said pressurized liquid housing module to said pressurized air chamber module, a nozzle module having a nozzle orifice for connection to said pressurized liquid housing module to receive pressurized liquid therefrom and flow through said nozzle orifice, second connecting means to connect said nozzle module to said pressurized liquid housing module, an elongated needle valve member module having a forwardly extending needle end tapering to a point for seating in said nozzle orifice for closure thereof when fully seated, an operating means module for connection to said pressurized air chamber module and to said needle valve member module to move said needle valve member module into and out of fully seated engagement with said nozzle orifice of said nozzle module, third connecting means to connect said operating means module to said pressurized air chamber module, fourth connecting means to connect said operating means module to said needle valve member module for movement thereof into and out of said fully seated engagement with said nozzle orifice, an atomization means module for connection to said pressurized air chamber module to receive pressurized air therefrom and direct it on said pressurized liquid as it flow through said nozzle orifice, and fifth connecting means to connect said atomization means module to said pressurized air chamber module, wherein said operating means module includes a first operating means module for connection to said needle valve member module to move it out of said fully seated engagement with said nozzle orifice for opening thereof, and a second operating means module for connection to said needle valve member module to move it into said fully seated engagement with said nozzle orifice for closure thereof, wherein said first operating means module includes a cylinder housing having a cylindrical cavity therein, a piston having a rearwardly facing bearing surface mounted for reciprocal movement in said cylindrical cavity, said cylinder housing having aperture means to receive said elongated needle valve member module for reciprocating movement therethrough, said elongated needle valve member having a forwardly facing bearing surface extending therefrom and positioned for bearing engagement with said rearwardly facing bearing surface of said piston when it moves rearwardly to thereby move said needle valve member module out of said fully seated engagement with said nozzle orifice for opening thereof, said fourth connecting means including said rearwardly facing bearing surface of said piston and said forwardly facing bearing surface of said needle valve member when in releasably connected bearing engagement with each other.

4. A spray gun for use in an automatic spray gun system as set forth in claim 3, wherein said second operating means module includes a rearwardly extending housing positioned rearwardly of said cylinder housing, a rearwardly extending cavity therein opening at its forwardly extending end to an open front wall to receive the rearwardly extending end of said needle valve member therethrough and into said cavity, needle biasing means biased forwardly in said rearwardly extending cavity having a forwardly facing bearing surface, said needle valve member having a rearwardly facing bearing surface extending therefrom and positioned for bearing engagement with said forwardly facing bearing surface of said forwardly biased needle biasing means to thereby bias said needle valve member module toward and into said fully seated engagement with said nozzle orifice for closure thereof, said fourth connecting means including said forwardly facing bearing surface of said needle biasing means and said rearwardly facing bearing surface of said needle valve member when in biasing connection bearing against each other.

5. A spray gun for use in an automatic spray gun system as set forth in claim 4, wherein said needle biasing means comprises a coil compression spring.

6. A spray gun for use in an automatic spray gun system as set forth in claim 5, wherein said cylinder housing includes a rearwardly facing solid annular wall surrounding a rearwardly facing open wall opening to said cylindrical cavity thereof, a removable cover member to cover said rearwardly facing open wall and said rearwardly facing solid annular wall, releasable securing means to secure said removable cover member to said cylinder housing, an aperture through said cover member in registration with said rearwardly extending cavity of said rearwardly extending housing and said open front wall thereof to receive said elongated needle valve member therethrough, a forward portion of said rearward extending cavity being received in said aperture through said cover member and secured thereto.

7. A spray gun for use in an automatic spray gun system as set forth in claim 6, wherein said rearwardly extending housing has a solid rearwardly facing end wall, an internally threaded aperture therethrough, an externally threaded fluid adjustment screw member threadedly received in said internally threaded aperture having a forwardly facing abutment end for abutting engagement against a rearwardly facing end portion of said needle valve member to limit rearward reciprocal movement thereof and correspondingly limit the distance said tapering needle end thereof may be withdrawn rearwardly from its seated engagement within said nozzle orifice to thereby regulate the flow of said pressurized liquid therethrough.

8. A spray gun for use in an automatic spray gun system as set forth in claim 7, wherein said fluid adjustment screw member includes a lock nut threaded thereon at a location rearwardly of said solid rearwardly facing end wall, said rearwardly extending housing includes a spacer portion extending rearwardly of said solid rearwardly facing end wall and having a cross-sectional dimension which is less than that of said rearwardly extending housing and its said end wall, said lock nut being rotatable on said fluid adjustment screw member for movement forwardly thereof into frictional bearing engagement against said spacer portion to releasably lock said fluid adjustment screw member against rotation within said internally threaded aperture of said solid rearwardly facing end wall of said rearwardly extending housing.

9. A spray gun for use in an automatic spray gun system as set forth in claim 8, wherein the cross-sectional dimension of said lock nut is no greater than the cross-sectional dimension of said rearwardly extending housing and its said rearwardly facing end wall.

10. A spray gun for use in an automatic spray gun system as set forth in claim 6, wherein said cylinder housing of said operating means module includes a forwardly facing solid end wall, said aperture means thereof includes a central aperture therethrough, said pressurized air chamber module includes a rearwardly facing solid end wall and a central aperture therethrough, said third connecting means to connect said operating means module to said pressurized air chamber module including a first internally threaded aperture opening to said rearwardly facing solid end wall of said pressurized air chamber module adjacent one side thereof and a second internally threaded aperture opening thereto adjacent the diametrically opposite side thereof, said cylinder housing includes a pair of diametrically opposite screw receiving channels through its cylindrical wall for registration with respective ones of said first and second internally threaded apertures of said pressurized air chamber module when said forwardly facing solid end wall of said cylinder housing is placed against said rearwardly facing solid end wall of said pressurized air chamber module with said central apertures of each also in registration with each other, said removable cover member includes a pair of diametrically opposite screw receiving channels therethrough for registration with respective ones of the said diametrically opposite screw receiving channels of said cylinder housing when said cover member is placed over said rearwardly facing open wall and rearwardly facing annular solid wall of said cylinder housing, and a pair of externally threaded cap screws received through respective ones of said screw receiving channels of said cover member and said cylinder housing to be threadedly received in respective ones of said first and second diametrically opposite internally threaded apertures opening to said rearwardly facing solid end wall of said pressurized air chamber module, to thereby connect said operating means module to said pressurized air chamber module.

11. A spray gun for use in an automatic spray gun system as set forth in claim 10, wherein said central aperture through said forwardly facing end wall of said cylinder housing includes a sleeve bearing secured therein, a reduced diameter bore through said sleeve bearing, an annular flange around the rearwardly facing end of said sleeve bearing positioned within said cylindrical cavity of said cylinder housing and in bearing engagement against the inner surface of said forwardly facing end wall thereof, said piston including an elongated cylindrical leg having an outer diameter corresponding in size to the reduced diameter bore through said sleeve bearing for sliding reciprocal movement therein, said piston including an enlarged diameter annular flange corresponding in size to the diameter of said cylindrical cavity of said cylinder housing for sliding reciprocal movement therein, said annular flange of said piston having an annular rearwardly facing surface comprising said rearwardly facing bearing surface and an annular forwardly facing surface for bearing engagement against said annular flange of said sleeve bearing when said piston is moved to its forward most position within said cylindrical cavity, an annular space between said forwardly facing annular surface of said piston flange and said inner surface of said forwardly facing solid end wall of said cylinder housing extending around and radially outward of said annular flange of said sleeve bearing, a piston operating pressure port opening at one end to said annular space within said cylindrical cavity in front of and around said forwardly facing surface of said piston flange and at its opposite end to a source of piston operating pressure connected thereto, a central bore through said cylindrical leg and annular flange of said piston to receive said elongated needle valve member therethrough, said forwardly facing bearing surface of said needle valve member module being positioned for bearing engagement with said rearwardly facing bearing surface of said piston flange, a compression spring in said cylindrical cavity biasing said piston to its forward most position therein, said piston moving rearwardly to thereby move said needle valve member rearwardly for opening of said nozzle orifice when operating pressure is delivered through said piston operating pressure port to fill said annular space and bear against the entire portion of said forwardly facing annular surface of said piston flange which faces said annular space.

12. A spray gun for use in an automatic spray gun system, comprising a plurality of individual module components and connecting means to assemble into an operational spray gun and to disassemble for cleaning, repair and replacement, including a pressurized air chamber module to receive pressurized air for atomization of liquid to be sprayed from said spray gun, a pressurized liquid housing module for connection to said pressurized air chamber module to receive pressurized liquid to be atomized and sprayed from said spray gun, first connecting means to connect said pressurized liquid housing module to said pressurized air chamber module, a nozzle module having a nozzle orifice for connection to said pressurized liquid housing module to receive pressurized liquid therefrom and flow through said nozzle orifice, second connecting means to connect said nozzle module to said pressurized liquid housing module, an elongated needle valve member module having a forwardly extending needle end tapering to a point for seating in said nozzle orifice for closure thereof when fully seated, an operating means module for connection to said pressurized air chamber module and to said needle valve member module to move said needle valve member module into and out of fully seated engagement with said nozzle orifice of said nozzle module, third connecting means to connect said operating means module to said pressurized air chamber module, fourth connecting means to connect said operating means module to said needle valve member module for movement thereof into and out of said fully seated engagement with said nozzle orifice, an atomization means module for connection to said pressurized air chamber module to receive pressurized air therefrom and direct it on said pressurized liquid as it flows through said nozzle orifice, and fifth connecting means to connect said atomization means module to said pressurized air chamber module, wherein said pressurized air chamber module includes an elongated cylindrical side wall, an open front wall at its forward end opening to an elongated atomizing air cylindrical cavity, said pressurized liquid housing module being secured within said atomizing air cylindrical cavity spaced apart inwardly a short distance from said open front wall which opens thereto, said pressurized liquid housing module having a liquid receiving chamber therein, a pair of spaced apart side walls each being spaced apart from the inner surface of said cylindrical side wall of said pressurized air chamber module toward which each respectively faces to provide a pair of spaced apart first and second air passageways along each opposite side of said liquid housing module within said elongated cylindrical cavity of said pressurized air chamber module, a top wall of said liquid housing module spaced apart from the inner surface of said cylindrical wall of said pressurized air chamber module toward which it faces to provide a third air passageway above the said top wall of said liquid housing module within said elongated cylindrical cavity of said pressurized air chamber module, a pair of laterally extending positioning arms extending outwardly from opposite sides of said liquid housing module at a point above the central axis of said elongated cylindrical cavity to reach and bear against respective facing portions of the inner surface of said elongated cylindrical side wall of said pressurized air chamber module, said pressurized liquid housing module having a bottom wall in bearing relationship against a facing bottom portion of the inner surface of said elongated cylindrical side wall at a point below the central axis of said elongated cylindrical cavity whereby said pressurized liquid housing module is held against lateral movement within said elongated cylindrical cavity, a pressurized liquid inlet port opening at one end to said liquid receiving chamber of said pressurized liquid housing module and at its opposite end to a source of pressurized liquid to which it is connected, said pressurized liquid housing module having an outlet port for discharge of pressurized liquid received in its said liquid receiving chamber, said first connecting means including said pair of laterally extending positioning arms of said pressurized liquid housing module to bear against said inner surface of said elongated cylindrical side wall at a point above the central axis of said elongated cylindrical cavity and its said bottom wall to bear against said elongated cylindrical side wall at a point below the central axis of said elongated cylindrical cavity to thereby removably connect said pressurized liquid housing module against lateral movement within said pressurized air chamber module, releasable longitudinal securing means to releasably secure said pressurized liquid housing module against longitudinal movement within said pressurized air chamber module, said pressurized liquid housing module being removable from said elongated atomizing air cylindrical cavity through its said open front wall when said longitudinal securing means is released.

13. A spray gun for use in an automatic spray gun system as set forth in claim 12, wherein said nozzle module comprises a body portion having a peripheral side wall extending longitudinally, a conical front wall extending from said peripheral side wall tapering inwardly as it extends forwardly to terminate at a narrow diameter opening comprising said nozzle orifice, a nozzle chamber bounded by said peripheral side wall and said conical front wall, opening at its forward end to said nozzle orifice and at its rearward end to a nozzle inlet port, including said nozzle inlet port, said nozzle inlet port and said outlet port of said pressurized liquid housing module having respective internal and external threads for threaded engagement of one within the other, said second connecting means including said threaded engagement of said nozzle inlet port and said outlet port of said pressurized liquid housing module.

14. A spray gun for use in an automatic spray gun system as set forth in claim 13, wherein said peripheral side wall of said body portion of said nozzle module comprises six flat sides each sloping inwardly toward the central axis at a slight angle as it extends forwardly from its rearward end to its forward end to integrally join said conical front wall, a plurality of six elongated ribs each integrally joined along a respective side edge of each of said six flat side and extending radially outwardly therefrom a short distance terminating in an elongated top edge having an arcuate cross-sectional outer surface configuration, said top edge of said elongated ribs extending substantially parallel to the central axis of said body portion and said nozzle chamber, said elongated ribs having said arcuate cross-sectional outer surface configuration defining a circle having a predetermined nozzle module diameter for co-operative engagement with said atomization means module.

15. A spray gun for use in an automatic spray gun system as set forth in claim 14, wherein said atomization means module includes an air cap member having a rearwardly facing annular wall, a first cylindrical outer wall extending forwardly thereof having an outer diameter corresponding to the inner diameter of said atomizing air cylindrical cavity for reception therein through said front wall thereof, a cavity in said air cap member opening rearwardly thereof in an opening bounded by said rearwardly facing annular wall, said cavity being bounded rearwardly by an inner cylindrical wall having an inner diameter corresponding to said pre-determined nozzle module diameter for reception of it therein, said cavity being bounded forwardly by an inner conical wall having a conical cross-section sufficiently large to receive said conical front wall of said nozzle module therein, said air cap member having a slightly reduced diameter second cylindrical outer wall extending forwardly from said first cylindrical outer wall, an annular abutment ledge extending around said air cap member at the junction of said first and second cylindrical outer walls, said second cylindrical outer wall terminating at a forwardly facing end wall, a central aperture through said forwardly facing end wall of said air cap member to receive a portion of the forward tapered end of said nozzle module and its said nozzle orifice therethrough, an annular space around and between the circumference of said central aperture of said air cap member and said portion of said tapered forward end of said nozzle module when received therein for flow of pressurized atomizing air through such annular space and said central aperture surrounding said nozzle orifice, said forwardly facing end wall of said air cap including a first atomizing air outlet face extending radially from said central aperture in one direction and projecting forwardly thereof at an obtuse angle relative to the axis of said central aperture, a second atomizing air outlet face extending radially from said central aperture in the diametrically opposite direction and projecting forwardly thereof at an obtuse angle relative to the axis of said central aperture, a first atomizing air outlet opening to said first atomizing air outlet face, a first atomizing air channel through said first and second cylindrical walls of said air cap opening to said rearwardly facing annular wall, a second atomizing air outlet opening to said second atomizing air outlet face, a second atomizing air channel through said first and second cylindrical walls of said air cap opening to said rearwardly facing annular wall at a location diametrically opposite from said opening of said first atomizing air channel, and adjustable retaining means to position and hold said air cap member in any one of a plurality of selectable positions within said open front wall of said atomizing air cylindrical cavity of said pressurized air chamber module relative to said nozzle module to achieve a variety of different spray patterns, said fifth connection means to connect said atomization means module to said pressurized air chamber module including said adjustable retaining means.

16. A spray gun for use in an automatic spray gun system as set forth in claim 15, wherein said adjustable retaining means includes a pattern ring member having an internally threaded cylindrical wall, an open rearwardly facing wall, a receiving cavity to receive therein the forward end portion of said elongated cylindrical wall of said pressurized air chamber module and said open front wall thereof, the outer diameter of said elongated cylindrical wall corresponding in dimension to that of said receiving cavity for reception therein, a forward end portion of said elongated cylindrical wall of said pressurized air chamber module having external threads to threadedly receive said internally threaded pattern ring member thereon, said pattern ring member having a solid annular forwardly facing end wall surrounding a pattern ring front wall aperture, said slightly reduced diameter second cylindrical outer wall of said air cap member being received through said pattern ring front wall aperture when said pattern ring member is in place on said forward end of said cylindrical wall of said pressurized air chamber module and said air cap member is in place within the said open front wall opening to said elongated atomizing air cylindrical cavity, said solid annular forwardly facing end wall of said pattern ring at such time engaging and bearing against said annular abutment ledge around said air cap member, a compression spring in said elongated atomizing air cylindrical cavity having its rearward end bearing against said pressurized liquid housing module and its forward end facing said rearwardly facing annular wall of said air cap member, an annular detent plate having a central aperture sandwiched between said forward end of said compression spring and said air cap member, said nozzle module extending through said central aperture of said annular detent plate, said compression spring biasing said detent plate and said air cap member forwardly into bearing engagement with said pattern ring member threadedly received on said forward end portion of said pressurized air chamber module whereby said air cap member and its atomizing air outlets can be moved forwardly and rearwardly relative to said nozzle orifice positioned within and extending through said central aperture of said air cap member to thereby adjust and vary the atomization of liquid as it flows through the nozzle orifice, including atomization into a wider spray pattern as said air cap member is moved rearwardly of said nozzle orifice and into a narrower spray pattern as said air cap member is moved forwardly thereof.

17. A spray gun for use in an automatic spray gun system as set forth in claim 16, wherein said detent plate includes first co-operative detent means, second co-operative detent means on said air cap member for co-operative engagement with said first co-operative detent means on said detent plate to releasable hold said air cap member in a selected rotational position relative to said detent plate when rotated thereto, said detent plate includes a first pair of diametrically opposed air passage slots extending radially outwardly from its said central aperture in a vertical direction and a second pair of diametrically opposed air passage slots extending radially outwardly from its said central aperture in a horizontal position, said air cap member being rotatable relative to said detent plate to a first operating position wherein its said diametrically opposed openings to said rearwardly facing annular wall of its said first and second atomizing air channels are in registration with said first pair of diametrically opposed air passage slots of said detent plate to produce an atomized fluid jet from said nozzle orifice which has an elongated oval horizontally extending cross-sectional configuration, said air cap member being rotatable relative to said detent plate to a second operating position wherein its said diametrically opposed openings to its said rearwardly facing annular wall of its said first and second atomizing air channels are in registration with said second pair of diametrically opposed air passage slots of said detent plate to produce an atomized fluid jet from said nozzle orifice which has an elongated oval vertically extending cross-sectional configuration, said air cap member being rotatable relative to said detent plate to a third operating position wherein its said diametrically opposed openings to its said rearwardly facing annular wall of its said first and second atomizing air channels are out of registration with any of said air passage slots of said detent plate and facing solid portions of said annular detent plate to produce an atomized fluid jet from said nozzle orifice which has a circular cross-sectional configuration, said first and second co-operative detent means being positioned to releasably hold said air cap member in each of said first, second and third operating positions when rotated thereto.

18. A spray gun for use in an automatic spray gun system as set forth in claim 12, wherein said elongated cylindrical side wall of said pressurized air chamber module includes an externally threaded section extending inwardly thereof from said open front wall for threaded connection of said atomization means module to said pressurized air chamber module, said fifth connection means including said threaded connection, including a forwardly positioned air pressure gauge to measure and indicate the air pressure within said atomizing air cylindrical cavity of said pressurized air chamber module, said air pressure gauge being positioned on and secured to said elongated cylindrical side wall at a forward position adjacent said externally threaded section thereof and above said third air passageway above the said top wall of said pressurized liquid housing module within said elongated cylindrical cavity of said pressurized air chamber module, a pressure gauge inlet port extending through said cylindrical side wall at one end to said air pressure gauge and at its opposite end to said third air passageway within said elongated cylindrical cavity, whereby the air pressure within said cavity of said pressurized air chamber module may be continuously monitored at the same time as the atomized spray from the forward end of said spray gun is also being continuously monitored.

19. A spray gun for use in an automatic spray gun system as set forth in claim 12, wherein said pressurized air chamber module includes a short enlarged diameter cylindrical wall section adjoining said elongated cylindrical side wall rearwardly thereof, the outer diameter of said enlarged diameter cylindrical wall section being greater than that of said elongated cylindrical side wall, said cylindrical wall of said enlarged diameter cylindrical wall section being thicker than the wall of said elongated cylindrical side wall, a mounting aperture through said thick cylindrical wall of said enlarged diameter cylindrical wall section to receive a corresponding mounting member of an automatic spray gun system to mount and position said spray gun for operation therein.

20. A spray gun for use in an automatic spray gun system as set forth in claim 19, wherein said enlarged diameter cylindrical wall section includes a reduced diameter atomizing air cylindrical cavity adjoining said elongated atomizing air cylindrical cavity rearwardly thereof, the inner diameter of said reduced diameter atomizing air cylindrical cavity being smaller than that of said elongated atomizing air cylindrical cavity, a connecting port opening at one end to said reduced diameter atomizing air cylindrical cavity and at its opposite end to a pressurized air supply source to which it is connected for flow of pressurized air into said reduced diameter atomizing air cylindrical cavity and then into said elongated atomizing air cylindrical cavity of said pressurized air chamber module.

21. A spray gun for use in an automatic spray gun system as set forth in claim 6, back pressure release means to release pressure in said cylinder housing rearwardly of said rearwardly facing bearing surface of said piston and thereby facilitate rearward movement of said piston in said cylinder housing, an annular air sealing O-Ring seated in an annular groove of said rearwardly facing solid annular wall of said cylinder housing, said back pressure release means including at least one air pressure release passageway through the cylindrical wall of said cylinder housing opening at one end to an intake aperture opening to said solid annular wall of said cylinder housing adjacent said rearwardly facing open wall opening to said cylindrical cavity and radially inwardly from said annular O-Ring, said air pressure release passageway opening at its opposite end to an outlet aperture in said cylindrical wall of said cylinder housing, and an air filter member mounted in said outlet aperture.

* * * * *